US006887168B2

(12) United States Patent
Hayashi et al.

(10) Patent No.: US 6,887,168 B2
(45) Date of Patent: May 3, 2005

(54) TWO-PIECE SOLID GOLF BALL

(75) Inventors: Junji Hayashi, Chichibu (JP); Yasumasa Shimizu, Chichibu (JP); Hiroshi Higuchi, Chichibu (JP); Yasushi Ichikawa, Chichibu (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 0 days.

(21) Appl. No.: 10/720,475

(22) Filed: Nov. 25, 2003

(65) Prior Publication Data

US 2004/0106473 A1 Jun. 3, 2004

(30) Foreign Application Priority Data

Nov. 29, 2002 (JP) ..... 2002-349185

(51) Int. Cl.[7] ..... A63B 37/14
(52) U.S. Cl. ..... 473/377
(58) Field of Search ..... 473/377, 376, 473/378, 351, 371

(56) References Cited

U.S. PATENT DOCUMENTS

| | | | | | |
|---|---|---|---|---|---|
| 4,955,613 | A | * | 9/1990 | Gendreau et al. | 473/372 |
| 2003/0114246 | A1 | * | 6/2003 | Yokota | 473/351 |
| 2003/0229183 | A1 | * | 12/2003 | Voorheis et al. | 525/232 |

FOREIGN PATENT DOCUMENTS

| | | | |
|---|---|---|---|
| JP | 07-268132 | A | 10/1995 |
| JP | 09-215778 | A | 8/1997 |
| JP | 09-271538 | A | 10/1997 |
| JP | 11-035633 | A | 2/1999 |
| JP | 11-178949 | A | 7/1999 |
| JP | 2002-293996 | A | 10/2002 |

OTHER PUBLICATIONS

Mark R. Mason et al.; "Hydrolysis of Tri–*tert*–butylaluminum: The First Structural Characterization of Alkylalumoxanes $[(R_2Al)_2O]_n$ and $(RAlO)_n$"; American Chemical Society; 115; 1993; pp. 4971–4984.

C. Jeff Harlan et al.; "Three–Coordinate Aluminum Is Not A Prerequisite for Catalytic Activity in the Zirconocene–Alumoxane Polymerization of Ethylene"; American Chemical Society; 117; 1995; pp. 6465–6474.

Report of Research & Development; Fine Chemical; vol. 23; No. 9; Jun. 1, 1994; pp. 5–15.

* cited by examiner

*Primary Examiner*—Raeann Gorden
(74) *Attorney, Agent, or Firm*—Sughrue Mion, PLLC

(57) ABSTRACT

Disclosed herein is a two-piece golf ball formed of a solid core and a cover, the solid core being formed from a rubber composition composed of a rubber base material of polybutadiene synthesized by using a catalyst of rare earth element, a small amount of organic peroxide, an unsaturated carboxylic acid and/or a metal salt thereof, an organic sulfur compound, and an inorganic filler, and the cover being formed mainly from a thermoplastic polyurethane material. The two-piece golf ball is by far superior to conventional ones in flying performance, cover durability, coating durability, and shot feeling.

13 Claims, 2 Drawing Sheets

TWO-PIECE SOLID GOLF BALL

BACKGROUND OF THE INVENTION

The present invention relates to a golf ball characterized by outstanding flying performance and shot feeling, which has a cover with improved scuff resistance and a coating film with improved wear resistance.

Many attempts have so far been made to prepare the cover of golf balls from a thermosetting polyurethane elastomer which is comparatively inexpensive and provides good shot feeling and scuff resistance. They are directed to improvement in shot feeling, controllability, and initial velocity (rebound resilience).

For example, Japanese Patent Laid-open No. Hei 9-215778 discloses a two-piece golf ball consisting of a rubber-based core having a specific gravity no lower than 1.00 and a cover having a specific gravity higher than that of the core. This golf ball has a moment of inertia which is adequately selected according to the hardness of the cover. Moreover, it has dimples with a prescribed area relative to its surface area, and its core and cover have an optimized hardness. With its cover formed from a thermoplastic polyurethane elastomer, it is improved in characteristic properties, such as flying distance, controllability, rollability and straight rolling on the putting green, rebound resilience, and durability on the cover by an iron shot.

Also, Japanese Patent Laid-open No. Hei 9-271538 discloses a golf ball consisting of a core and a cover, in which the cover is formed mainly from a thermoplastic polyurethane elastomer (based on an aliphatic diisocyanate) having adequate viscoelastic properties. This golf ball is claimed to be superior in controllability, initial velocity (rebound resilience), scuff resistance caused by iron shot, discoloration, and moldability.

Moreover, Japanese Patent Laid-open No. Hei 11-178949 discloses a solid golf ball having a cover formed mainly from a reaction product of a thermoplastic polyurethane elastomer and an isocyanate compound. It claims that this golf ball has improved moldability, shot feeling, controllability, initial velocity (rebound resilience and flying distance), and scuff resistance caused by iron shot.

Existing golf balls still have room for further improvement in shot feeling and flying performance. The new golf ball to be developed should exhibit improved flying performance and soft shot feeling and have improved scuff resistance for its cover and improved wear resistance for its coating film.

SUMMARY OF THE INVENTION

The present invention was completed in view of the foregoing. It is an object of the present invention to provide a golf ball which exhibits improved flying performance and soft shot feeling and has improved scuff resistance on its cover and improved wear resistance for its coating film.

To achieve the above-mentioned object, the present inventors carried out a series of researches, which led to the finding that a two-piece solid golf ball consisting of a solid core and a cover is by far superior to the conventional one in flying performance, soft shot feeling, and scuff resistance and wear resistance, if the core is specified in diameter, flexibility, and raw material (rubber composition), and the cover is specified in thickness, hardness, and raw material (thermoplastic polyurethane), so that the golf ball as a whole has flexibility in a specific range.

The present invention is directed to a two-piece golf ball as defined in the following.

The first aspect: A two-piece solid golf ball made up of a solid core and a cover wherein the solid core is formed from a rubber composition composed of (A) 100 parts by weight of rubber base material containing 60 to 100 wt % of polybutadiene synthesized by using a catalyst of rare earth element and contains no less than 60% of cis-1,4-linkage, (B) 0.1 to 0.8 parts by weight of organic peroxide compound, (C) an unsaturated carboxylic acid and/or a metal salt thereof, (D) an organic sulfur compound, and (E) an inorganic filler and the solid core deforms by 3.0 to 5.5 mm under a load of 980 N (100 kgf) and has a diameter of 37 to 42 mm, and the cover is formed mainly from (F) a thermoplastic polyurethane material and has a thickness of 0.5 to 2.5 mm and a Shore D hardness of 50 to 70, and that the two-piece solid golf ball made up of a solid core and a cover deforms by 3.0 to 5.0 mm under a load of 980 N (100 kgf).

The second aspect: The two-piece solid golf ball as defined in the first aspect, wherein the polybutadiene is a modified polybutadiene obtained by synthesis with an Nd-based catalyst as the catalyst of rare earth element and subsequent reaction with a terminal modifier.

The third aspect: The two-piece solid golf ball as defined in the first or second aspect, wherein the rubber composition is one which is composed of (A) 100 parts by weight of rubber base material containing 60 to 100 wt % of polybutadiene synthesized by using a catalyst of rare earth element and contains no less than 60% of cis-1,4-linkage, (B) more than one kind of organic peroxide compound, (C) 10 to 60 parts by weight of an unsaturated carboxylic acid and/or a metal salt thereof, (D) 0.1 to 5 parts by weight of an organic sulfur compound, and (E) 5 to 80 parts by weight of an inorganic filler.

The fourth aspect: The two-piece solid golf ball as defined in any of the first to third aspects, wherein the thermoplastic polyurethane material as component (F) is composed of (M) a thermoplastic polyurethane and (N) an isocyanate mixture, the isocyanate mixture as component (N) being composed of (N-1) an isocyanate compound having two or more isocyanate groups as functional groups in one molecule and (N-2) a thermoplastic resin which does not substantially react with the isocyanate groups, with the (N-1) being dispersed in the (N-2).

The fifth aspect: The two-piece solid golf ball as defined in any of the first to fourth aspects, wherein the cover has a coating film on the surface thereof, the coating film being formed from a golf ball coating composition containing a hydroxyl group-containing polyester obtained by reaction between a polyhydric alcohol and a polybasic acid and also containing a non-yellowing polyisocyanate, the polyhydric alcohol having at least partly an alicyclic structure in the molecule.

The sixth aspect: The two-piece solid golf ball as defined in any of the first to fifth aspects, wherein the cover has a large number of dimples in the surface thereof such that the dimple volume ratio (VR) is 0.70 to 1.00% and the dimple surface area ratio (SR) is 70 to 85%, with VR being defined as the ratio of the sum total of the volumes of individual dimples under the plane surrounded by the periphery of each dimple to the volume of a virtual sphere without dimples in the cover, and SR being defined as the ratio of the sum total of the areas surrounded by the periphery of individual dimples to the surface area of the virtual sphere.

DESCRIPTION OF THE PREFERRED EMBODIMENTS

Figure 1:
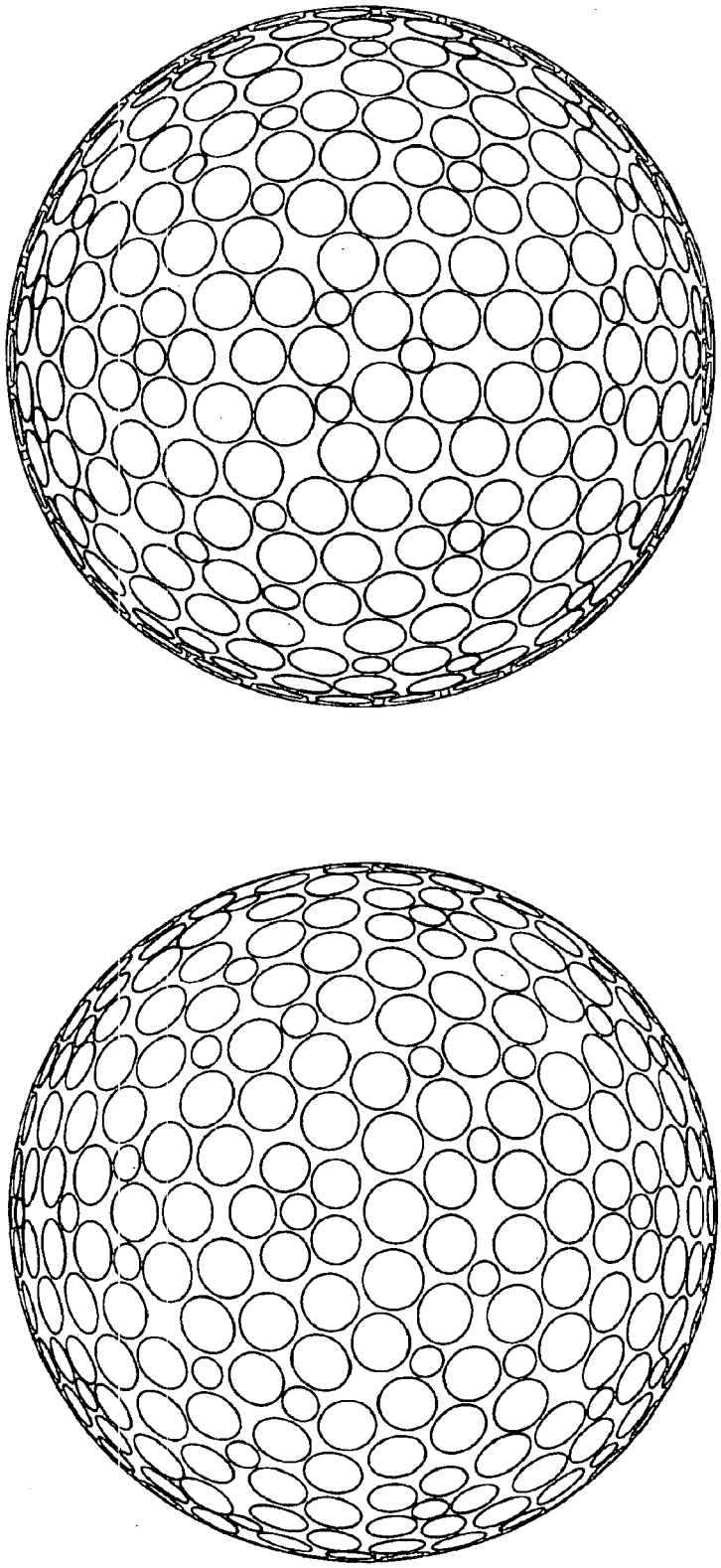
FIG. 1 is a schematic diagram illustrating the arrangement of the dimples (type A or type C) in table 3.

The invention will be described in more detail in the following.

According to the present invention, the solid core is formed from a rubber composition containing the following components.

(A) Rubber base material containing 60 to 100 wt % of polybutadiene synthesized by using a catalyst of rare earth element and contains no less than 60% of cis-1,4-linkage;

(B) Organic peroxide compound;

(C) Unsaturated carboxylic acid and/or metal salt thereof.

(D) Organic sulfur compound; and (E) Inorganic filler.

In component (A), which is a rubber base material containing 60 to 100 wt % of polybutadiene synthesized by using a catalyst of rare earth element and contains no less than 60% of cis-1,4-linkage, the content of cis-1,4-linkage in the polybutadiene should be no less than 60%, preferably no less than 80%, more preferably no less than 90%, and most desirably no less than 95%. If the content of cis-1,4-linkage in the polybutadiene is less than 60%, the resulting golf ball will not have the desired rebound resilience.

According to the present invention, the polybutadiene mentioned above is one which is synthesized by using a catalyst of rare earth element. This catalyst is not specifically restricted, and any known one can be used. It includes compounds of rare earth elements (lanthanoid), organoaluminum compounds, alumoxane, and halogen-containing compounds, which may optionally be combined with a Lewis base.

The compounds of lanthanoid rare earth elements mentioned above include halides, carboxylates, alcoholates, thioalcoholates, and amides of metals having an atomic number from 57 to 71.

The organoaluminum compounds mentioned above include those compounds which are represented by $AlR^1R^2R^3$ (where $R^1$, $R^2$, and $R^3$, which may be the same or different, each denotes hydrogen or a $C_{1-8}$ hydrocarbon residue).

The alumoxane mentioned above includes those compounds represented by the formula (I) or (II) below. It may be an association product of alumoxane which is described in Fine Chemical, 23, (9), 5(1994), J. Am. Chem. Soc., 115, 4971 (1993), and J. Am. Chem. Soc., 117, 6465 (1995).

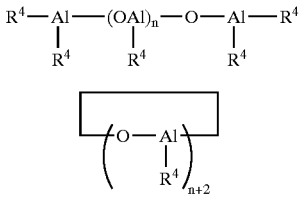

(I)

(II)

where $R^4$ denotes a $C_{1-20}$ hydrocarbon group, and n denotes an integer of 2 or above.

The halogen-containing compounds mentioned above include aluminum halides represented by $AlX_nR_{3-n}$ (where X denotes a halogen, R denotes a $C_{1-20}$ hydrocarbon group (such as alkyl group, aryl group, and aralkyl group), and n denotes 1, 1.5, 2, or 3) and strontium halides represented by $Me_3SrCl$, $Me_2SrCl_2$, $MeSrHCl_2$, and $MeSrCl_3$. Additional examples include such metal halides as silicon tetrachloride, tin tetrachloride, and titanium tetrachloride.

The Lewis base mentioned above is one which is used for complexing the compound of lanthanoid rare earth element. It includes acetylacetone and ketone alcohol.

According to the present invention, the compound of lanthanoid rare earth element may be a neodymium compound. The catalyst of this compound is desirable because of its polymerization activity which yields polybutadiene with a low content of 1,4-cis linkage and a high content of 1,2-vinyl linkage. Typical examples of the catalyst of rare earth element are described in Japanese Patent Laid-open No. Hei 11-35633.

In polymerization of butadiene by a catalyst of rare earth element which is a compound of lanthanoid rare earth element, the molar ratio of butadiene to the catalyst should be 1,000 to 2,000,000, preferably 5,000 to 1,000,000, so that the resulting polymer has the cis content and the Mw/Mn ratio. In the case where the catalyst is composed of $AlR^1R^2R^3$ and a compound of lanthanoid rare earth element, the molar ratio of butadiene to the catalyst should be 1 to 1,000, preferably 3 to 500, and in the case where the catalyst is composed of halide compound and a compound of lanthanoid rare earth element, the molar ratio of butadiene to the catalyst should be 0.1 to 30, preferably 0.2 to 15. In the case where the catalyst is composed of a Lewis base and a compound of lanthanoid rare earth element, the molar ratio of butadiene to the catalyst should be 0 to 30, preferably 1 to 10. Polymerization may be achieved by solution polymerization with a solvent or bulk polymerization or gas phase polymerization without a solvent. The polymerization temperature is usually from −30 to 150° C., preferably from 10 to 100° C.

The thus obtained polybutadiene should have a Mooney viscosity ($ML_{1+4}$ (100° C.)) no lower than 40, preferably no lower than 50, more preferably no lower than 52, and most desirably no lower than 54. Its upper limit is usually no higher than 140, preferably no higher than 120, more preferably no higher than 100, and most desirably no higher than 80. With a Mooney viscosity outside the above-mentioned range, the polybutadiene will be poor in workability and rebound resilience.

Incidentally, the Mooney viscosity used in the present invention is an industrial viscosity index (conforming to JIS-K6300) measured by a Mooney viscometer, which is one kind of rotary plastometers. It is represented by the unit symbol of $ML_{1+4}$ (100° C.), in which M stands for Mooney viscosity, L stands for Large rotor (type L), 1+4 stands for 1 minute of duration of preliminary heating and 4 minutes of duration of rotation, and 100° C. denotes the heating temperature at which measurements are made.

According to the present invention, the polybutadiene obtained by using the catalyst of rare earth element may optionally be treated with a terminal modifier which reacts with the active terminals of the polymer.

The terminal modifier may be any known one selected from the following seven groups.

(1) Compounds having an alkoxysilyl group, such as alkoxysilane compounds having at least one epoxy group or isocyanate group in the molecule. Examples of the epoxy group-containing compounds include 3-glycidyloxypropyltrimethoxysilane, 3-glycidyloxypropyltriethoxysilane, (3-glycidyloxy-propyl)methyldimethoxysilane, (3-glycidyloxypropyl)methyldiethoxylsilane, β-(3,4-epoxycyclohexyl)trimethoxysilane, β-3,4-epoxycyclohexyl)triethoxysilane, β-(3,4-epoxycyclohexyl)methyldimethoxysilane, β-(3,4-epoxycyclohexyl)ethyldimethoxysilane, condensate of 3-glycidyloxypropyltrimethoxysilane, condensate of (3-glycidyloxypropyl)methyldiethoxylsilane, and condensate of (3-glycidyloxypropyl)methyldimethoxysilane. Examples of the isocyanate group-containing alkoxysilane compounds include 3-isocyantepropyltrimethoxysilane, 3-isocyanatepropyltriethoxysilane, (3-isocyanatepropyl)-methyldimethoxysilane, (3-isocyanatepropyl) methyldiethoxy-silane, condensate of 3-isocyanatepropyltrimethoxysilane, and condensate of (3-isocyanatepropyl)methyldimethoxysilane.

The reaction of the alkoxysilyl compound with active terminals may be promoted by the addition of a Lewis acid, so that the Lewis acid catalyses and accelerates the coupling reaction. The modified polymer thus obtained has good storage stability owing to improved cold flow properties. Examples of the Lewis acid include dialkyltin dialkyl maleate, dialkyltin dicarboxylate, and aluminum trialkoxide.

(2) Organometal halide compounds, metal halide compounds and organic metal compounds represented by the following formulas.

$R^5nM'X_{4-n}$, $M'X_4$, $M'X_3$, $R^5_nM'(—R^6—COOR^7)_{4-n}$, and $R^5_nM'(—R^6—COR^7)_{4-n}$ (where $R^5$ and $R^6$ (which are identical or different) each denote a $C_{1-20}$ hydrocarbon group, $R^7$ denotes a $C_{1-20}$ hydrocarbon group which may have a carbonyl group or ester group in the side chain, M' denotes tin, silicon, germanium, or phosphorus, X denotes halogen, and n is an integer of 0 to 3.)

(3) Heterocumulene compounds having the Y═C═Z linkage in the molecule (where Y denotes carbon, oxygen, nitrogen, or sulfur, and Z denotes oxygen, nitrogen, or sulfur).

(4) 3-membered heterocyclic compounds having the following linkage in the molecule.

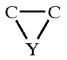

where Y denotes oxygen, nitrogen, or sulfur.

(5) Halogenated isocyano compounds.

(6) Carboxylic acids, acid halides, ester compounds, carbonate ester compounds, and acid anhydrides represented by the following formulas.

$R^8—(COOH)_m$, $R^9(COX)_m$, $R^{10}—(COO—R^{11})_m$, $R^{12}—OCOO—R^{13}$, $R^{14}—(COOCO)—R^{15})_m$, and

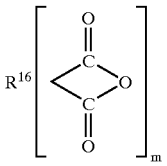

where $R^8$ to $R^{16}$ which may be identical or different, each denotes a $C_{1-50}$ hydrocarbon group, X denotes halogen, and m is an integer of 1 to 5.

(7) Metal salts of carboxylic acid represented by the following formulas.

$R^{17}_1M''(OCOR^{18})_{4-1}$, $R^{19}_1M''(OCO—R^{20}—COOR_{21})_{4-1}$, and

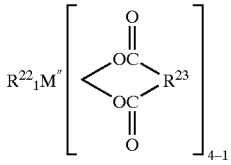

where $R^{17}$ to $R^{23}$ which may be identical or different, each denotes a $C_{1-50}$ hydrocarbon group, M" denotes tin, silicon, or germanium, and 1 is an integer of 0 to 3.

The examples and reactions of the terminal modifiers mentioned above are described in Japanese Patent Laid-open Nos. Hei 11-35633, Hei 7-268132, and 2002-293996.

Incidentally, of the above-mentioned catalysts, those of rare earth element, particularly Nd are preferable.

According to the present invention, the above-mentioned polybutadiene should have a molecular weight distribution Mw/Mn (where Mw denotes the weight-average molecular weight and Mn denotes the number-average molecular weight) no less than 2.0, preferably no less than 2.2, more preferably no less than 2.4, and most desirably no less than 2.6. Its upper limit should be no less than 8.0, preferably no less than 7.5, more preferably no less than 4.0, and most desirably no less than 3.4. With an excessively small Mw/Mn, the polybutadiene will be poor in workability. Conversely, with an excessively large Mw/Mn, the polybutadiene will be poor in rebound resilience.

According to the present invention, component (A) mentioned above is a rubber base material composed mainly of the above-mentioned polybutadiene. The content of the polybutadiene in the rubber base material should be no less than 60 wt %, preferably no less than 70 wt %, more preferably no less than 80 wt %, and most desirably no less than 85 wt %. The polybutadiene in the rubber base material may account for 100 wt %, 95 wt % or less, or 90 wt % or less. If the content of polybutadiene is less than 60 wt %, the resulting rubber is poor in rebound resilience.

Incidentally, component (A) mentioned above contains, in addition to the polybutadiene specified above, any polybutadiene other than the polybutadiene specified above, synthesized by using a catalyst of Group VIII metal, other diene rubbers such as styrene-butadiene rubber, natural rubber, isoprene rubber, and ethylene-propylene-diene rubber.

The second polybutadiene (as an additional rubber component) should preferably be one which is synthesized by using a catalyst of Group VIII metal. It should have a Mooney viscosity ($ML_{1+4}$ (100° C.)) lower than 50 and a solution viscosity η no lower than 200 mPa·s and no higher than 400 mPa·s at 25° C. (5 wt % in toluene), so that the resulting rubber has high rebound resilience and improved workability.

The catalyst of Group VIII metal mentioned above includes, for example, nickel catalysts and cobalt catalysts enumerated in the following.

Nickel catalysts: nickel-diatomaceous earth (one-component type), Raney nickel/titanium tetrachloride (two-component type), and nickel compound/organometallic compound/boron trifloride etherate (three-component type). Incidentally, the nickel compound includes reduced nickel with a carrier, Raney nickel, nickel oxide, nickel carboxylate, and organic nickel complex salt. The organometallic compound includes trialkylaluminum, such as triethylaluminum, tri-n-propyl-aluminum, triisobutylaluminum, and tri-n-hexylaluminum, alkyllithium, such as n-butyllithium, sec-butyllithium, tert-butyllithium, and 1,4-dilithiumbutane, dialkylzinc, such as diethylzinc and dibutylzinc.

Cobalt catalysts: Raney cobalt, cobalt chloride, cobalt bromide, cobalt iodide, cobalt oxide, cobalt sulfate, cobalt carbonate, cobalt phosphate, cobalt phthalate, cobalt carbonyl, cobalt acetylacetonate, cobalt diethyldithiocarbamate, cobalt anilinium nitrite, cobalt dinitrocyclochloride, and so forth. They should preferably be used in combination with a dialkylaluminum monochloride such as diethylaluminum monochloride and diisobutylaluminum monochloride, a trialkylaluminum such as trimethylaluminum, tri-n-propylaluminum, triisobutylaluminum, and tri-n-hexylaluminum, an aluminum alkylsesquichloride such as ethylaluminum sesquichloride, or aluminum chloride.

The catalyst of Group VIII metal mentioned above, particularly nickel-based catalyst or cobalt-based catalyst, is used for polymerization in such a way that it is continuously fed, together with butadiene monomer, into the reactor. Polymerization should be carried out at a reaction temperature of 5 to 60° C. and a reaction pressure ranging from about 1 to 70 atm, so that the resulting rubber has the Mooney viscosity specified above.

The second polybutadiene mentioned above should have a Mooney viscosity lower than 50, preferably lower than 48, and more preferably lower than 45. The lower limit of Mooney viscosity should be no lower than 10, preferably no lower than 20, more preferably no lower than 25, and most desirably no lower than 30.

Also, the second butadiene should have a solution viscosity $\eta$ (5 wt % in toluene at 25° C.) no lower than 200 mPa·s, preferably no lower than 210 mPa·s, more preferably no lower than 230 mPa·s, and most desirably no lower than 250 mPa·s, and no higher than 400 mPa·s, preferably no higher than 370 mPa·s, more preferably no higher than 340 mPa·s, and most desirably no higher than 300 mPa·s.

The solution viscosity $\eta$ (5 wt % in toluene at 25° C.) is a viscosity of a solution containing a polybutadiene sample (2.28 g) dissolved in toluene (50 mL), which is measured at 25° C. by using a specific viscometer which has been calibrated with the standard solution (JIS-Z8809).

The amount of the second polybutadiene in the rubber base material should be no less than 0%, preferably no less than 5%, and more preferably no less than 10%, and no more than 40%, preferably no more than 30%, more preferably no more than 20%, and most desirably no more than 15%.

The organic peroxide as component (B) in the present invention should preferably be a combination of two or more kinds. The one having the shortest half-life (at 155° C.) is referred to as component (a), and the one having the longest half-life (at 155° C.) is referred to as component (b). If component (a) has a half-life of $a_t$ and component (b) has a half-life of $b_t$, then the ratio of $b_t/a_t$ should be no less than 7, preferably no less than 8, more preferably no less than 9, and most desirably no less than 10, and no more than 20, preferably no more than 18, and more preferably no more than 16. Even though more than one kind of organic peroxide is used, the resulting rubber might be poor in rebound resilience, compression, and durability if they do not meet the above-mentioned requirement.

The half-life $a_t$ (at 155° C.) of component (a) should be no less than 5 seconds, preferably no less than 10 seconds, and more preferably no less than 15 seconds, and no more than 120 seconds, preferably no more than 90 seconds, and more preferably no more than 60 seconds. The half-life $b_t$ (at 155° C.) of component (b) should be no less than 300 seconds, preferably no less than 360 seconds, and more preferably no less than 420 seconds, and no more than 800 seconds, preferably no more than 700 seconds, and more preferably no more than 600 seconds.

The organic peroxide mentioned above includes, for example, dicumyl peroxide, 1,1'-bis(t-butylperoxy)-3,5,5-trimethylcyclohexane, and $\alpha,\alpha'$-bis(t-butylperoxy) diisopropylbenzene. These organic peroxides are commercially available under the trade name of "Percumyl D" (from NOF CORPORATION), "Perhexa 3M" (from NOF CORPORATION), and "Luperco 231XL" (from Atochem). A preferred example of component (a) is 1,1'-bis(t-butylperoxy)-3,5,5-trimethylcyclohexane, and a preferred example of component (b) is dicumyl peroxide.

The total amount of the organic peroxides including components (a) and (b), based on 100 parts by weight (pbw) of component (A), should be no less than 0.1 pbw, preferably no less than 0.2 pbw, more preferably no less than 0.3 pbw, and most desirably no less than 0.4 pbw. Its upper limit should be no more than 0.8 pbw, preferably no more than 0.7 pbw, more preferably no more than 0.6 pbw, and most desirably no more than 0.5 pbw. With an excessively small amount, the resulting rubber composition takes a long time for crosslinking, which leads to low productivity, and has large decompression. With an excessively large amount, the resulting rubber is poor in rebound resilience and durability.

According to the present invention, the core should be formed from polybutadiene synthesized by using a catalyst of rare earth element, particularly an Nd-based catalyst, and the addition amount of the organic peroxides should be set in the range above-specified, so that the resulting golf ball has high rebound resilience. High rebound resilience makes the solid core or the golf ball as a whole soft, which leads to increased flying distance and mild shot feeling owing to low spin and high initial velocity at the time of full shot with a driver.

The amount of component (a), based on 100 pbw of component (A), should be no less than 0.05 pbw, preferably no less than 0.08 pbw, and more preferably no less than 0.1 pbw, and no more than 0.5 pbw, preferably no more than 0.4 pbw, and more preferably no more than 0.3 pbw. The amount of component (b) should be no less than 0.05 pbw, preferably no less than 0.15 pbw, and more preferably no less than 0.2 pbw, and no more than 0.7 pbw, preferably no more than 0.6 pbw, and more preferably no more than 0.5 pbw.

The unsaturated carboxylic acid and/or metal salt thereof as component (C) include acrylic acid, methacrylic acid, maleic acid, and fumaric acid as the unsaturated carboxylic acid, especially acrylic acid and methacrylic acid are preferable; and also include zinc salt and magnesium salt as the metal salt of the unsaturated carboxylic acid, especially zinc acrylate is preferable.

The amount of component (C), based on 100 pbw of component (A), should be no less than 10 pbw, preferably no less than 15 pbw, and more preferably no less than 20 pbw. Its upper limit should be no more than 60 pbw, preferably no more than 50 pbw, more preferably no more than 45 pbw, and most desirably no more than 40 pbw. With an amount outside the above-specified range, the resulting golf ball will be poor in rebound resilience and shot feeling.

According to the present invention, the organic sulfur compound as component (D) includes thiophenol, thionaphthol, halogenated thiophenol, and metal salts thereof. Their typical examples include pentathiophenol, pentafluorothiophenol, pentabromothiophenol, and parachlorothiophenol, and zinc salts thereof; diphenylpolysulfide, dibenzylpolysulfide, dibenzolylpolysulfide, dibenzothiazoylpolysulfide, dithiobenzoylpolysulfide (polysulfide having 2 to 4 sulfur atoms), alkylphenyldisulfide, sulfur compounds having a furan ring, and sulfur compounds having a thiophen ring. Of these examples, zinc salt of pentachlorothiphenol and diphenyldisulfide are preferable.

The amount of component (D), based on 100 pbw of component (A), should be no less than 0.1 pbw, preferably no less than 0.2 pbw, more preferably no less than 0.4 pbw, and most desirably no less than 0.7 pbw, and no more than 5 pbw, preferably no more than 4 pbw, more preferably no more than 3 pbw, and most desirably no more than 2 pbw, particularly no more than 1.5 pbw. With an excessively small amount, component (D) does not produce the effect of improving rebound resilience. With an excessively large amount, the resulting rubber is too soft to produce the desired rebound resilience.

According to the present invention, the inorganic filler as component (E) includes, for example, zinc oxide, barium sulfate, and calcium carbonate. The amount of component (E), based on 100 pbw of component (A), should be no less than 5 pbw, preferably no less than 7 pbw, more preferably no less than 10 pbw, and most desirably no less than 13 pbw. Its upper limit should be no more than 80 pbw, preferably no more than 65 pbw, more preferably no more than 50 pbw, and most desirably no more than 40 pbw. With an excessively small or large amount, the resulting golf ball will not have the specified weight and desired rebound resilience.

The rubber composition containing components (A) to (E) mentioned above may optionally be incorporated with an age resistor. The amount of age resistor, based on 100 pbw of component (A), should be no less than 0.05 pbw, preferably no less than 0.1 pbw, and more preferably no less than 0.2 pbw, and no more than 3 pbw, preferably no more than 2 pbw, more preferably no more than 1 pbw, and most desirably no more than 0.5 pbw.

The age resistor may be commercially available under the trade name of "Nocrack NS-6" and "Nocrack NS-30" (both from OUCHISHINKO CHEMICAL INDUSTRIAL Co., LTD.) and "Yoshinox 425" (from Yoshitomi Pharmaceutical Industrial Co., Ltd.).

According to the present invention, the solid core mentioned above is molded from the rubber composition containing components (A) to (E) mentioned above. Molding should preferably be achieved by vulcanizing and curing the rubber composition. Vulcanization may take 10 to 40 minutes at 100–200° C.

The solid core molded as mentioned above may have an adequately controlled distribution of local hardness. In other words, the solid core may be uniform or varied in local hardness from the center to the surface.

The solid core should have a diameter no less than 37 mm, preferably no less than 38 mm, and more preferably no less than 39 mm. Its upper limit should be no more than 42 mm, preferably no more than 41 mm, and more preferably no more than 40 mm. A solid core with a diameter smaller than 37 mm will adversely affects the shot feeling and rebound resilience. On the other hand, a solid core with a diameter larger than 42 mm makes the resulting golf ball poor in cracking resistance.

The solid core mentioned above should have an amount of defection under a load of 980 N (100 kgf) which is no less than 3.0 mm, preferably no less than 3.5 mm, more preferably no less than 3.6 mm, far preferably no less than 3.7 mm, and most desirably no less than 4.0 mm. Its upper limit should be no more than 5.5 mm, preferably no more than 5.4 mm, more preferably no more than 5.3 mm, and most desirably no more than 5.0 mm. With an amount of deflection less than 3.0 mm, the resulting golf ball is poor in shot feeling and is also poor in flying performance owing to spin at the time of long shot because the ball undergoes large deformation by the driver. On the other hand, with an amount of deflection more than 5.5 mm, the resulting golf ball is poor in shot feeling and rebound resilience, so that flying performance is reduced, and is subject to cracking by repeated shots.

The solid core mentioned above should have a specific gravity (g/cm$^3$) no less than 0.9, preferably no less than 1.0, and more preferably no less than 1.1. Its upper limit should be no more than 1.4, preferably no more than 1.3, and more preferably no more than 1.2.

According to the present invention, the cover is formed mainly from the thermoplastic polyurethane material as component (F), which will occasionally be abbreviated as "cover material".

The thermoplastic polyurethane material as component (F) contains a thermoplastic polyurethane as component (M) and an isocyanate mixture as component (N). The isocyanate mixture as component (N) is composed of (N-1) an isocyanate compound having two or more isocyanate groups as functional groups in one molecule and (N-2) a thermoplastic resin which does not substantially react with the isocyanate groups, with the former being dispersed in the latter.

According to the present invention, the thermoplastic polyurethane as component (M) is not specifically restricted so long as it is a thermoplastic resin composed mainly of polyurethane. It should preferably be composed of a polymeric polyol compound constituting the soft segment, a diisocyanate constituting the hard segment, and a monomeric chain extender.

The polymeric polyol compound is not specifically restricted; it includes, for example, polyester polyol and polyether polyol. Polyether polyol is preferable from the stand point of rebound resilience and low-temperature properties.

The polyether polyol includes polytetramethylene glycol and polypropylene glycol, with the former being preferable. They should have a number-average molecular weight of 1000 to 5000, preferably 1500 to 3000.

The diisocyanate is not specifically restricted; it includes for example, aromatic diisocyanate such as 4,4'-diphenylmethane diisocyanate, 2,4-toluenediisocyanate, and 2,6-toluenediisocyanate, and aliphatic diisocyanate such as hexamethylene diisocyanate. Of these examples, 4,4'-diphenylmethane diisocyanate is preferable from the standpoint of stability in the isocyanate mixture mentioned later.

The monomeric chain extender is not specifically restricted; it includes for example, ordinary polyhydric alcohols and amines, such as 1,4-butyleneglycol, 1,2-ethyleneglycol, 1,3-propyleneglycol, 1,3-butanediol, 1,6-hexyleneglycol, 2,2-dimethyl-1,3-propanediol, 1,3-butyleneglycol, dicyclo-hexylmethylmethanediamine (hydrogenated MDA), and isophor-one-diamine (IPDA). The chain extender should preferably have an average molecular weight of 20 to 15000.

The polyurethane elastomer mentioned above may be commercially available under the trade name of "Pandex" T7298, TR3080, T8290, T8295, and T8260 (from DIC-Bayer Polymer), and "Rezamine" 2593 and 2597 (from Dainichiseika Color & Chemicals Mfg. Co., Ltd.). They may be used alone or in combination with one another.

According to the present invention, the cover should preferably be formed from the thermoplastic polyurethane as component (F) mentioned above which is additionally incorporated with a specific isocyanate mixture mentioned later. The result of incorporation with such an isocyanate mixture is that the resulting golf ball is superior in shot feeling, controllability, cut resistance, scuff resistance, and crack resistance (after repeated shots) to the conventional golf balls having an outer cover formed mainly from an ordinary polyurethane elastomer alone.

According to the present invention, the isocyanate mixture as component (N) should preferably be one which is composed of (N-1) an isocyanate compound having two or more isocyanate groups as functional groups in one molecule and (N-2) a thermoplastic resin which does not substantially react with the isocyanate groups, with the former being dispersed in the latter.

The isocyanate compound as component (N-1) may be any isocyanate compound used in the conventional technology relating to polyurethane. It includes aromatic isocyanate compounds, hydrogenated products of aromatic isocyanate compounds, aliphatic diisocyanates, and alicyclic diisocyanates, which are merely exemplary.

The aromatic isocyanate compound includes, for example, 2,4-toluenediisocyanate, 2,6-toluenediisocyanate, a mixture thereof, 4,4'-diphenylmethane diisocyanate, m-phenylenediisocyanate, and 4,4'-biphenyldiisocyanate.

The hydrogenated product of an aromatic isocyanate compound includes dicyclohexylmethanediisocyanate.

The aliphatic diisocyanate includes, for example, tetramethylenediisocyanate, hexamethylenediisocyanate (HDI), and octamethylenediisocyanate.

The alicyclic diisocyanate includes, for example, xylenediisocyanate.

The thermoplastic resin as component (N-2) should preferably be one which has low water absorption and good miscibility with the thermoplastic polyurethane material. It includes, for example, polystyrene resin, polyvinyl chloride resin, ABS resin, polycarbonate resin, and polyester elastomer (such as polyether-ester block copolymer and polyester-ester block copolymer), which are merely exemplary. Polyether-ester block copolymers are preferable from the standpoint of rebound resilience and strength.

The isocyanate mixture should be prepared by mixing component (N-2) and component (N-1) in a ratio of from 100:5 to 100:100 (by weight), preferably from 100:10 to 10:40 (by weight). If the amount of component (N-1) relative to component (N-2) is excessively small, it is necessary to add the isocyanate mixture in a larger amount sufficient for crosslinking reaction with the polyurethane elastomer. As the result, the effect of component (N-2) is so significant that the crosslinked polyurethane elastomer is poor in physical properties. Conversely, component (N-1) used in an excessively large amount causes slipping during mixing operation, thereby presenting difficulties in preparation of the mixture.

The isocyanate mixture may be obtained by thoroughly mixing together components (N-1) and (N-2) at 130 to 250° C. in a mixing roll or Banbury mixer, followed by pelletizing or crushing after cooling.

The isocyanate mixture may be commercially available under the trade name of "Crosnate EM30" (from Dainichiseika Color & Chemicals Mfg. Co., Ltd.) and others.

The amount of the isocyanate mixture, based on 100 pbw of the thermoplastic polyurethane as component (M), should be no less than 1 pbw, preferably no less than 5 pbw, and more preferably no less than 10 pbw. Its upper limit should be no more than 100 pbw, preferably no more than 50 pbw, and more preferably no more than 30 pbw. With an excessively small amount, the isocyanate mixture does not provide sufficient crosslinking reactions, which leads to poor physical properties. With an excessively large amount, the isocyanate mixture causes significant discoloration due to time, heat, and UV light, and the resulting product is poor in rebound resilience.

According to the present invention, the cover of the golf ball should preferably be formed mainly from the thermoplastic polyurethane as component (M). However, it may optionally be incorporated with additives such as pigment, dispersing agent, antioxidant, UV light absorber, UV light stabilizer, plasticizer, and inorganic filler (such as zinc oxide, barium sulfate, and titanium dioxide).

The amount of the additives, based on 100 pbw of the thermoplastic polyurethane as component (F), should be 0.1 to 50 pbw, preferably 0.5 to 30 pbw, and more preferably 1 to 6 pbw. Additives in an excessively large amount lower durability. Additives in an excessively small amount do not produce their effect.

According to the present invention, the cover material should have a hardness (Shore D) no lower than 50, preferably no lower than 53, and no higher than 70, preferably no higher than 64. With an excessively low hardness, the cover material is poor in rebound resilience. With an excessively high hardness, the cover material is poor in shot feeling and controllability. The Shore hardness (D) is measured by using a durometer type D, according to ASTM D2240.

The cover material mentioned above has improved scuff resistance and improved adhesion to the coating material mentioned later.

The combination of the soft core and the above-mentioned cover results in a golf ball which is soft and yet is capable of long fly. This golf ball gives a mild shot feeling and has improved scuff resistance and crack resistance because it is soft enough to provide a large area for contact with the club, thereby dispersing impact, when it is hit.

The two-piece golf ball according to the present invention consists of the core mentioned above and the cover formed from the cover material mentioned above.

The cover may be formed by any known method without specific restrictions. It is usually formed by injection molding which causes a melt of the cover material to flow into a cavity in which the previously prepared cored is placed. Production in this manner ensures improved fluidity and moldability and yields a golf ball having high rebound resilience.

According to an alternative method, the golf ball may be formed in two stages. First, the cover material is made into a pair of semispherical cups and then the cups are joined together, with the core enclosed therein, under pressure at 120 to 170° C. for 1 to 5 minutes.

According to the present invention, the cover material should have a properly controlled melt flow rate so that it provides improved fluidity for injection molding and improved moldability. The melt flow rate (MFR), which is measured at 190° C. under a load of 21.18 N (2.16 kg) according to JIS-K6760, should be no lower than 0.5 dg/min, preferably no lower than 1 dg/min, more preferably no lower than 1.5 dg/min, and most desirably no lower than 2 dg/min. Its upper limit should be no higher than 20 dg/min, preferably no higher than 10 dg/min, more preferably no higher than 5 dg/min, and most desirably no higher than 3 dg/min. With an excessively high or low melt flow rate, the cover material will be extremely poor in processability.

The cover formed from the cover material should have a thickness no less than 0.5 mm, preferably no less than 0.9 mm, and more preferably no less than 1.1 mm. Its upper limit should be no more than 2.5 mm and preferably no more than 2.0 mm. With an excessively large or small thickness, the cover is poor in rebound resilience or poor in durability, respectively.

According to the present invention, the cover of the two-piece golf ball permits a large number of dimples to be formed therein and accepts a variety of surface treatments such as priming, stamping, and coating. The dimples should be arranged in such a way that there is not any single great circle which does not cross the dimples. Failing to meet this requirement brings about variation in flying performance.

As the dimples described above, it is preferable that the type and number of the dimples are adequately controlled. By the synergistic effect produced by forming the arrangement, type, and number of the dimples as described above, the resulting golf ball exhibits improved flying performance with a stable trajectory.

The type of the dimples varies depending on the diameter and/or depth of the dimples. Two or more types, preferably three or more types, should be used. No more than eight types, particularly no more than six types, should be used.

The total number of dimples should be no less than 300, and preferably no less than 320. Its upper limit should be no more than 480, and preferably no more than 455. With an excessively large or small number, the dimples do not provide an adequate lift necessary for improved flying performance.

The above-mentioned dimples should have an adequate dimple volume ratio (VR) and an adequate dimple surface area ratio (SR). The VR and SR produce a synergistic effect of improving the trajectory, lift, and flying distance.

The dimple volume ratio (VR) in % is defined as the ratio of the volume of a virtual golf ball without dimples to the volume of dimples on an actual golf ball. The two-piece golf ball according to the present invention should have a VR value (%) of no less than 0.70, preferably no less than 0.75, and no more than 1.00, preferably no more than 0.82, more preferably no more than 0.79.

The dimple surface area ratio (SR) in % is defined as the ratio of the total area of dimples to the surface area of a virtual sphere. The SR value (%) should be no less than 70, preferably no less than 72, and no more than 85, more preferably no more than 83.

With VR values and SR values outside the range specified above, the resulting golf ball will be poor in flying distance due to incorrect trajectories.

When combined with the solid core and cover mentioned above, the adequately designed dimples ensure a long flying distance with a high trajectory, while preventing dropping.

The dimple volume ratio (VR) and the dimple surface area ratio (SR) are calculated from measurements of a finished golf ball. For example, in case of the ball being processed final coating such as painting and stamping on the surface thereof following to the forming of the cover described above, the calculation is implemented based on the shape of the dimples of the finished golf ball which have undergone all processes.

The two-piece solid golf ball of the present invention may have a coating film on its cover. This coating film may be formed from a golf ball coating composition containing a hydroxyl group-containing polyester obtained by reaction between a polyhydric alcohol and a polybasic acid and also containing a non-yellowing polyisocyanate, the polyhydric alcohol having at least partly an alicyclic structure in the molecule. The coating composition is superior in cohesive strength, resistance to impact (due to repeated shots by the club), resistance to wear (by sand in the banker), resistance to stain (with grass sap), weather resistance, and water resistance. It also closely adheres to the cover specified in the present invention.

The two-piece golf ball according to the present invention may follow the regulation of the golf competition, so as to have a diameter no less than 42.67 mm, and also have a weight no less than 45.0 g, preferably no less than 45.2 g, and no more than 45.93 g, as prescribed by the official rule.

The two-piece golf ball according to the present invention consists of the core and cover as specified above and has a large number dimples as specified above. The ball as a whole should have an amount of defection under a load of 980 N (100 kgf) which is no less than 3.0 mm, preferably no less than 3.2 mm, more preferably no less than 3.4 mm, and most desirably no less than 3.6 mm. Its upper limit should be no more than 5.0 mm, preferably no more than 4.8 mm, more preferably no more than 4.6 mm, and most desirably no more than 4.4 mm. With an amount of deflection less than 3.0 mm, the resulting golf ball is poor in shot feeling and is also poor in flying performance owing to spin at the time of long shot because the ball undergoes large deformation by the driver. On the other hand, with an amount of deflection more than 5.0 mm, the resulting golf ball is poor in shot feeling and rebound resilience (and hence flying performance) and is subject to cracking by repeated shots.

EXAMPLE

The present invention will be described in more detail with reference to the following Examples and Comparative Examples, which are not intended to restrict the scope thereof.

The present invention provides a two-piece golf ball which is by far superior to conventional ones in flying performance, cover durability, coating durability, and shot feeling.

Examples 1 to 3 and Comparative Examples 1 to 3

In each example, a solid core was made from the rubber composition shown in Table 1 by vulcanization at 155° C. for 17 minutes.

Figure 2:
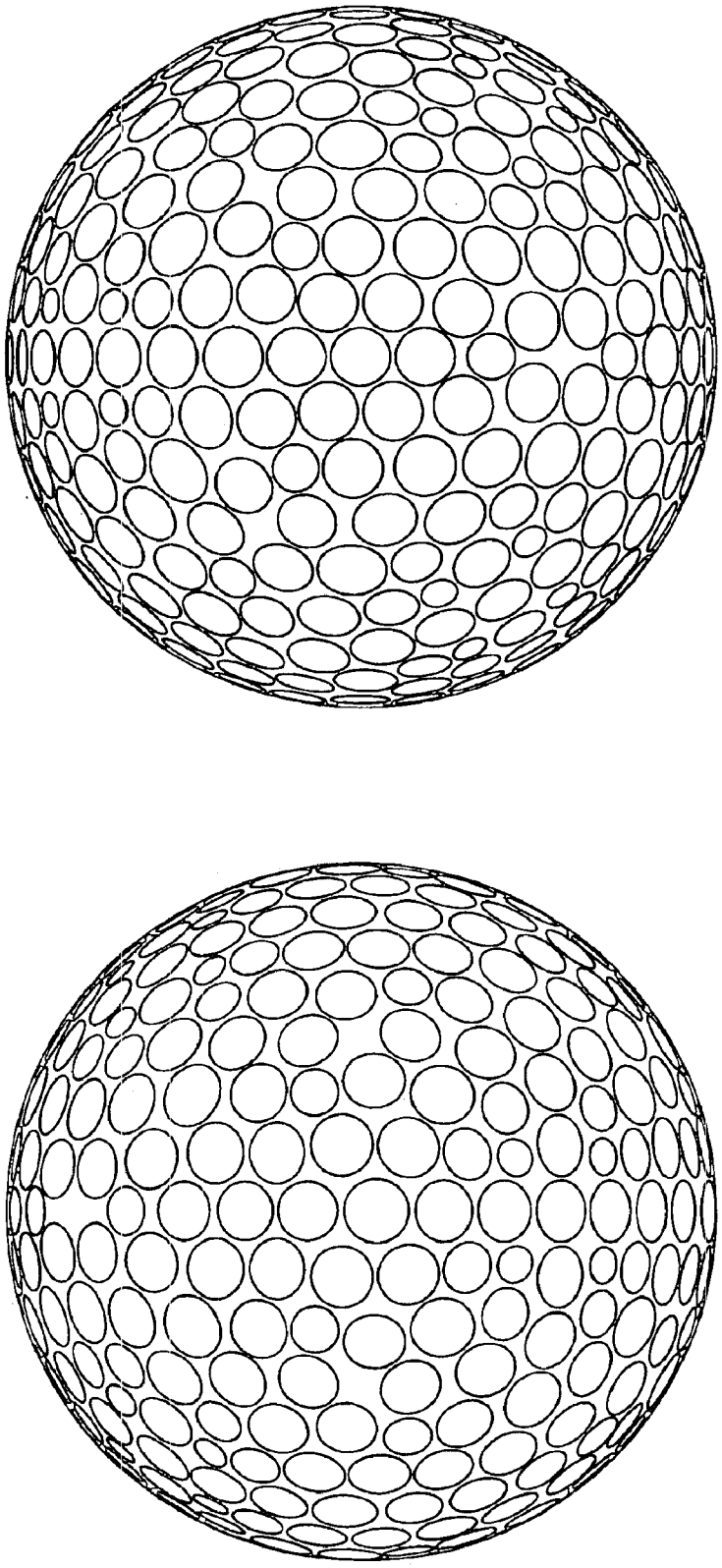
FIG. 2 is a schematic diagram illustrating the arrangement of the dimples (type B) in table 3.

A cover material of the composition shown in Table 2 was prepared by mixing at 200° C. in a twin-screw extruder, followed by pelletizing. The thus obtained cover material was injection-molded into a cavity in which the above-mentioned solid core had been placed. In this way, a two-piece golf ball was produced. The types of dimples on the cover are shown in Table 3. The arrangement of dimples (types A to C) is illustrated in FIGS. 1 and 2.

The physical properties of the resulting golf balls are shown in Table 4.

TABLE 1

| Components | | Example | | | Comparative Example | | |
|---|---|---|---|---|---|---|---|
| (pbw) | | 1 | 2 | 3 | 1 | 2 | 3 |
| Rubber composition | HCBN-13 | 100 | 100 | 100 | | | |
| | BR01 | | | | 50 | 50 | 50 |
| | BR11 | | | | 50 | 50 | 50 |

TABLE 1-continued

| Components (pbw) | | Example 1 | Example 2 | Example 3 | Comparative Example 1 | Comparative Example 2 | Comparative Example 3 |
|---|---|---|---|---|---|---|---|
| Organic peroxide | Perhexa 3M-40 | 0.3 | 0.3 | 0.3 | 0.6 | 0.6 | 0.6 |
| | Percumyl D | 0.3 | 0.3 | 0.3 | 0.6 | 0.6 | 0.6 |
| Metal salt of unsaturated carboxylic acid | Zinc acrylate | 28.4 | 27.0 | 29.8 | 27.0 | 26.0 | 30.5 |
| Organic sulfur compound | Zinc salt of pentathiochlorophenol | 1.0 | 1.0 | 1.0 | 1.0 | 1.0 | 1.0 |
| Inorganic filler | Zinc oxide | 12.0 | 12.6 | 11.2 | 12.5 | 13.0 | 14.8 |
| Age resistor | Nocrack NS-6 | 0.1 | 0.1 | 0.1 | 0.1 | 0.1 | 0.1 |

Note to Table 1

HCBN-13: A product from JSR Corporation. Containing 96% of cis-1,4 linkage. Having a Mooney viscosity ($ML_{1+4}$ (100° C.)) of 53 and a molecular weight distribution (Mw/Mn) of 3.2. Produced by using an Nd catalyst.

BR01: A product from JSR Corporation. Containing 96% of cis-1,4 linkage. Having a Mooney viscosity ($ML_{1+4}$ (100° C.)) of 44 and a molecular weight distribution (Mw/Mn) of 4.2. Produced by using an Ni catalyst. Having a solution viscosity of 150 mPa.s.

BR11: A product from JSR Corporation. Containing 96% of cis-1,4 linkage. Having a Mooney viscosity ($ML_{1+4}$ (100° C.)) of 44 and a molecular weight distribution (Mw/Mn) of 4.1. Produced by using an Ni catalyst. Having a solution viscosity of 270 mPa.s.

Perhexa 3M-40: A product from NOF CORPORATION. A 40% diluted version. The amount added is expressed in terms of the net weight of 1,1-bis(t-butylperoxy)-3,3,5-trimethylcyclohexane.

Percumyl D: A product from NOF CORPORATION. Dicumyl peroxide.

Zinc acrylate: A product from NIHON JYORYU KOGYO CO., LTD.

Zinc salt of pentachlorothiophenol: A product from TOKYO KASEI KOGYO CO., LTD.

Zinc oxide: A product from SAKAI CHEMICAL INDUSTRY CO., LTD.

Nocrack NS-6: A product from OUCHISHINKO CHEMICAL INDUSTRIAL Co., LTD. 2,2'-methylenebis(4-methyl-6-t-butylphenol).

TABLE 2

| Component (pbw) | Example 1 | Example 2 | Example 3 | Comparative Example 1 | Comparative Example 2 | Comparative Example 3 |
|---|---|---|---|---|---|---|
| Pandex T8260 | 50 | 100 | | 50 | 100 | |
| Pandex T8295 | 50 | | 100 | 50 | | |
| Crosnate EM30 | 15 | 15 | 15 | | | |
| Surlyn 7930 | | | | | | 47 |
| Surlyn 6320 | | | | | | 40 |
| Nucrel 9-1 | | | | | | 13 |
| Titanium dioxide | 2 | 2 | 2 | 2 | 2 | 2 |

Note to Table 2

Pandex T8260: A product from DIC Bayer Polymer Ltd. Thermoplastic polyurethane elastomer.

Pandex T8295: A product from DIC Bayer Polymer Ltd. Thermoplastic polyurethane elastomer.

Crosnate EM30: A product from Dainichiseika Color & Chemicals Mfg. Co., Ltd.

Surlyn 7930: A product from DuPont in the US. Ionomer resin.

Surlyn 6320: A product from DuPont in the US. Ionomer resin.

Nucrel 9-1: A product from DuPont in the US. Ternary acid copolymer.

TABLE 3

| Type of dimple | | A | B | C |
|---|---|---|---|---|
| Total number | | 432 | 398 | 432 |
| VR (%) | | 0.81 | 0.92 | 1.03 |
| SR (%) | | 78.6 | 74.5 | 78.6 |
| Number of dimple types | | 3 | 4 | 3 |
| Dimple type 1 | Diameter (mm) | 3.9 | 4.1 | 3.9 |
| | Depth (mm) | 0.16 | 0.19 | 0.2 |
| | Number | 300 | 48 | 300 |
| Dimple type 2 | Diameter (mm) | 3.4 | 3.8 | 3.4 |
| | Depth (mm) | 0.13 | 0.18 | 0.17 |
| | Number | 60 | 254 | 60 |
| Dimple type 3 | Diameter (mm) | 2.6 | 3.2 | 2.6 |
| | Depth (mm) | 0.10 | 0.16 | 0.14 |
| | Number | 72 | 72 | 72 |

TABLE 3-continued

| Type of dimple | | A | B | C |
|---|---|---|---|---|
| Dimple type 4 | Diameter (mm) | | 2.4 | |
| | Depth (mm) | | 0.12 | |
| | Number | | 24 | |

Note to Table 3

VR (%)

The ratio (%) of the sum total of the volumes of individual dimples under the plane surrounded by the periphery of each dimple to the volume of a virtual sphere without dimples in the surface thereof.

SR (%)

The ratio (%) of the sum total of the areas surrounded by the periphery of individual dimples to the surface area of a virtual sphere, assuming that the golf ball is a virtual sphere without dimples.

TABLE 4

| Physical propertied (pbw) | | Example 1 | Example 2 | Example 3 | Comparative Example 1 | Comparative Example 2 | Comparative Example 3 |
|---|---|---|---|---|---|---|---|
| Core | Outside diameter (mm) | 40.3 | 40.3 | 40.7 | 40.3 | 40.3 | 40.7 |
| | Hardness (mm) | 3.8 | 4.0 | 3.6 | 3.8 | 4.0 | 3.0 |
| Cover | Thickness (mm) | 1.2 | 1.2 | 1.0 | 1.2 | 1.2 | 1.0 |
| | Hardness | 55 | 58 | 53 | 54 | 57 | 53 |
| Type of dimples | | A | A | B | A | C | A |
| Ball | Outside diameter (mm) | 42.7 | 42.7 | 42.7 | 42.7 | 42.7 | 42.7 |
| | Weight (g) | 45.3 | 45.3 | 45.3 | 45.2 | 45.2 | 45.3 |
| | Hardness (mm) | 3.6 | 3.6 | 3.6 | 3.6 | 3.7 | 2.9 |
| Flying performance | Initial velocity (m/s) | 66.2 | 66.1 | 66.3 | 65.8 | 65.7 | 66.2 |
| | Spin (rpm) | 2560 | 2500 | 2610 | 2580 | 2490 | 2850 |
| | Carry (m) | 214.0 | 213.0 | 214.5 | 211.5 | 207.0 | 213.5 |
| | Total (m) | 236.5 | 235.5 | 236.0 | 233.0 | 230.0 | 232.0 |
| Shot feeling | Driver | ○ | ○ | ○ | ○ | ○ | X |
| | Putter | ○ | ○ | ○ | ○ | ○ | Δ |

TABLE 4-continued

| Physical propertied | Example | | | Comparative Example | | |
|---|---|---|---|---|---|---|
| (pbw) | 1 | 2 | 3 | 1 | 2 | 3 |
| Scuff resistance | ○ | ○ | ○ | X | X | X |
| Durability of coating film | ○ | ○ | ○ | ○ | ○ | X |

Note to Table 4
Core diameter
An average of five measurements on the surface.
Core hardness
An amount of deformation (mm) under a load of 980 N (100 kgf).
Cover thickness
Calculated from (Outside diameter of ball − Outside diameter of core) ÷ 2
Cover hardness
Shore D hardness measured according to ASTM D-2240.
Ball outside diameter
An average of five measurements on the surface without dimples.
Ball hardness (mm)
An amount of deformation (mm) under a load of 980 N (100 kgf).
Flying performance
Measured by using a shot machine (from Miyamae Co., Ltd). Sample balls were hit with a driver (W#1) at a head speed of 40 m/s to measure the initial velocity, spin, carry, and total flying distance.
Shot feeling
Rated by a majority of five advanced amateur golfers who hit sample balls with a driver (W#1) and a putter.
○: soft
Δ: normal
X: hard
Scuff resistance
Rated according to the following criterion by visually observing damages made on the ball which was hit (after keeping at 23° C.) at a head speed of 33 m/s by a swing robot machine provided with a pitching wedge.
○: no damage or almost unnoticeable damage
X: severe damage with surface fluffing or dimple cracking
Durability of coating film
Rated according to the following criterion by visually checking sample balls for surface damage, loss of surface gloss, and adhesion of sand, after mixing for 2 hours with 3 liters of bunker sand in an 8-liter porcelain ball mill. For comparison, the same test was also performed on "Altus Newing" (from Bridgestone Sports Co., Ltd.)
○: better than comparative balls
Δ: equal to comparative balls
X: poorer than comparative balls The present invention is not limited to the detailes of the above dscribed preferred embodiments. The scope of the invention is defined by the appended claims and all changes and modifications as fall within the equivalence of the scope of the claims are therefore to be embraced by the invention.

Japanese Patent Application No. 2002-349185 is incorporated herein by reference.

Although some preferred embodiments have been described, many modifications and variations may be made thereto in light of the above teachings. It is therefore to be understood that the invention may be practiced otherwise than as specifically described without departing from the scope of the appended claims.

What is claimed is:

1. A two-piece solid golf ball made up of a solid core and a cover wherein said solid core is formed from a rubber composition composed of (A) 100 parts by weight of rubber base material containing 60 to 100 wt % of polybutadiene synthesized by using a catalyst of rare earth element and contains no less than 60% of cis-1,4-linkage, (B) 0.1 to 0.8 parts by weight of organic peroxide compound, (C) an unsaturated carboxylic acid and/or a metal salt thereof, (D) an organic sulfur compound selected from thiophenol, thionaphthol, halogenated thiophenol, and metal salts thereof, and (E) an inorganic filler and said solid core deforms by 3.0 to 5.5 mm under a load of 980 N (100 kgf) and has a diameter of 37 to 42 mm, and said cover is formed mainly from (F) a thermoplastic polyurethane material and has a thickness of 0.5 to 2.5 mm and a Shore D hardness of 50 to 70, and said two-piece solid golf ball made up of a solid core and a cover deforms by 3.0 to 5.0 mm under a load of 980 N (100 kgf).

2. The two-piece solid golf ball of claim 1, wherein the polybutadiene is a modified polybutadiene obtained by synthesis with an Nd-based catalyst as the catalyst of rare earth element and subsequent reaction with a terminal modifier.

3. The two-piece solid golf ball of claim 1, wherein the rubber composition is one which is composed of (A) 100 parts by weight of rubber base material containing 60 to 100 wt % of polybutadiene synthesized by using a catalyst of rare earth element and contains no less than 60% of cis-1, 4-linkage, (B) more than one kind of organic peroxide compound, (C) 10 to 60 parts by weight of an unsaturated carboxylic acid and/or a metal salt thereof, (D) 0.1 to 5 parts by weight of an organic sulfur compound, and (E) 5 to 80 parts by weight of an inorganic filler.

4. The two-piece solid golf ball of claim 1, wherein the thermoplastic polyurethane material as component (F) is composed of (M) a thermoplastic polyurethane and (N) an isocyanate mixture, said isocyanate mixture as component (N) being composed of (N-1) an isocyanate compound having two or more isocyanate groups as functional groups in one molecule and (N-2) a thermoplastic resin which does not substantially react with said isocyanate groups, with the (N-1) being dispersed in the (N-2).

5. The two-piece solid golf ball of claim 1, wherein the cover has a coating film on the surface thereof, said coating film being formed from a golf ball coating composition containing a hydroxyl group-containing polyester obtained by reaction between a polyhydric alcohol and a polybasic acid and also containing a non-yellowing polyisocyanate, said polyhydric alcohol having at least partly an alicyclic structure in the molecule.

6. The two-piece solid golf ball of claim 1, wherein the cover has a large number of dimples in the surface thereof such that the dimple volume ratio (VR) is 0.70 to 1.00% and the dimple surface area ratio (SR) is 70 to 85%, with VR being defined as the ratio of the sum total of the volumes of individual dimples under the plane surrounded by the periphery of each dimple to the volume of a virtual sphere without dimples in the cover, and SR being defined as the ratio of the sum total of the areas surrounded by the periphery of individual dimples to the surface area of the virtual sphere.

7. The two-piece solid golf ball of claim 1, wherein said organic sulfur compound is a compound selected from the group consisting of pentathiophenol, pentafluorothiophenol, pentabromothiophenol, and parachlorothiophenol, and zinc salts thereof, diphenylpolysulfide, dibenzylpolysulfide, dibenzolylpolysulfide, dibenzothiazoylpolysulfide, dithiobenzolypolysulfide, alkylphenyldisulfide, sulfur compounds having a furan ring, and sulfur compounds having a thiophen ring.

8. The two-piece sold golf ball of claim 1, wherein said organic sulfur compound is a zinc salt of pentachlorothiophenol or diphenyldisulfide.

9. The two-piece sold golf ball of claim 1, wherein a second polybutadiene, which is different from said polybutadiene synthesized by using a catalyst of rare earth element, is added to the core wherein the second polybutadiene has a Mooney viscosity lower than 50 and is synthesized using a Group VIII metal.

10. A two-piece solid golf ball made up of a solid core and a cover wherein said solid core is formed from a rubber composition composed of (A) 100 parts by weight of rubber base material containing 60 to 100 wt % of polybutadiene synthesized by using a catalyst of rare earth element and contains no less than 60% of cis-1,4-linkage, (B) 0.1 to 0.8 parts by weight of more than one organic peroxide compound, (C) 10 to 60 parts by weight of an unsaturated carboxylic acid and/or a metal salt thereof, (D) 0.1 to 5 parts by weight of an organic sulfur compound, and (E) 5 to 80 parts by weight of an inorganic filler and said solid core deforms by 3.0 to 5.5 mm under a load of 980 N (100 kgf) and has a diameter of 37 to 42 mm, and said cover is formed mainly from (F) a thermoplastic polyurethane material and has a thickness of 0.5 to 2.5 mm and a Shore D hardness of 50 to 70, and said two-piece solid golf ball made up of a solid core and a cover deforms by 3.0 to 5.0 mm under a load of 980 N (100 kgf).

11. A two-piece solid golf ball made up of a solid core and a cover wherein said solid core is formed from a rubber composition composed of (A) 100 parts by weight of rubber base material containing 60 to 100 wt % of polybutadiene synthesized by using a catalyst of rare earth element and contains no less than 60% of cis-1,4-linkage, (B) 0.1 to 0.8 parts by weight of organic peroxide compound, (C) an unsaturated carboxylic acid and/or a metal salt thereof, (D) an organic sulfur compound, and (E) an inorganic filler and said solid core deforms by 3.0 to 5.5 mm under a load of 980 N (100 kgf) and has a diameter of 37 to 42 mm, and said cover is formed mainly from (F) a thermoplastic polyurethane material composed of (M) a thermoplastic polyurethane and (N) an isocyanate mixture, said isocyanate mixture as component (N) being composed of (N-1) an isocyanate compound having two or more isocyanate groups as functional groups in one molecule and (N-2) a thermoplastic resin which does not substantially react with said isocyanate groups, with the (N-1) being dispersed in the (N-2) and has a thickness of 0.5 to 2.5 mm and a Shore D hardness of 50 to 70, and said two-piece solid golf ball made up of a solid core and a cover deforms by 3.0 to 5.0 mm under a load of 980 N (100 kgf).

12. A two-piece solid golf ball made up of a solid core and a cover wherein said solid core is formed from a rubber composition composed of (A) 100 parts by weight of rubber base material containing 60 to 100 wt% of polybutadiene synthesized by using a catalyst of rare earth element and contains no less than 60% of cis-1,4-linkage, (B) 0.1 to 0.8 parts by weight of organic peroxide compound, (C) an unsaturated carboxylic acid and/or a metal salt thereof, (D) an organic sulfur compound, and (E) an inorganic filler and said solid core deforms by 3.0 to 5.5 mm under a load of 980 N (100 kgf) and has a diameter of 37 to 42 mm, and said cover is formed mainly from (F) a thermoplastic polyurethane material and has a thickness of 0.5 to 2.5 mm and a Shore D hardness of 50 to 70, and said two-piece solid golf ball made up of a solid core and a cover deforms by 3.0 to 5.0 mm under a load of 980 N (100 kgf), wherein the cover has a coating film on the surface thereof, said coating film being formed from a golf ball coating composition containing a hydroxyl group-containing polyester obtained by reaction between a polyhydric alcohol and a polybasic acid and also containing a non-yellowing polyisocyanate, said polyhydric alcohol having at least partly an alicyclic structure in the molecule.

13. A two-piece solid golf ball made up of a solid core and a cover wherein said solid core is formed from a rubber composition composed of (A) 100 parts by weight of rubber base material containing 60 to 100 wt% of polybutadiene synthesized by using a catalyst of rare earth element and contains no less than 60% of cis-1,4-linkage, (B)0.1 to 0.8 Parts by weight of organic peroxide compound, (C) an unsaturated carboxylic acid and/or a metal salt thereof, (D) an organic sulfur compound, and (E) an inorganic filler and said solid core deforms by 3.0 to 5.5 mm under a load of 980 N (100 kgf) and has a diameter of 37 to 42 mm, and said cover is formed mainly from (F) a thermoplastic polyurethane material and has a thickness of 0.5 to 2.5 mm and a Shore D hardness of 50 to 70, and said two-piece solid golf ball made up of a solid core and a cover deforms by 3.0 to 5.0 mm under a load of 980 N (100 kgf), wherein the cover has a large number of dimples in the surface thereof such that the dimple volume ratio (VR) is 0.70 to 1.00% and the dimple surface area ratio (SR) is 70 to 85%, with VR being defined as the ratio of the sum total of the volumes of individual dimples under the plane surrounded by the periphery of each dimple to the volume of a virtual sphere without dimples in the cover, and SR being defined as the ratio of the sum total of the areas surrounded by the periphery of individual dimples to the surface area of the virtual sphere.

* * * * *